United States Patent [19]

Lee

[11] Patent Number: 4,796,542

[45] Date of Patent: Jan. 10, 1989

[54] SECURITY LOCK FOR REVOLVING DOOR

[76] Inventor: Choong G. Lee, 510F Keawe St., Honolulu, Hi. 96813

[21] Appl. No.: 63,261

[22] Filed: Jun. 17, 1987

[51] Int. Cl.[4] ..... E05G 3/00

[52] U.S. Cl. ..... 109/8; 109/3; 49/42

[58] Field of Search ..... 109/8, 3, 2; 49/42, 49/13, 25

[56] References Cited

U.S. PATENT DOCUMENTS

| | | | |
|---|---|---|---|
| 1,455,677 | 5/1923 | Stevens . | |
| 1,493,690 | 5/1924 | Martin . | |
| 1,558,058 | 10/1925 | Spottswood | 109/8 |
| 1,570,927 | 1/1926 | Spottswood | 109/3 |
| 1,877,017 | 9/1932 | Murphy | 109/3 |
| 1,948,217 | 2/1934 | Goodwin | 109/3 |
| 1,952,393 | 3/1934 | Tigue . | |
| 1,979,497 | 11/1934 | Schneider et al. . | |
| 1,992,096 | 2/1935 | Reger | 109/8 |
| 2,090,520 | 8/1937 | Schneider | 109/3 |
| 2,186,385 | 1/1940 | Lockart . | |
| 2,695,574 | 11/1954 | Ceci . | |
| 3,045,615 | 7/1962 | Atchison | 109/3 |
| 3,285,209 | 11/1966 | Pace . | |
| 4,060,935 | 12/1977 | Miller et al. . | |
| 4,341,165 | 7/1982 | Calandritti et al. . | |

*Primary Examiner*—Robert L. Wolfe

*Attorney, Agent, or Firm*—Stephen F. K. Yee

[57] ABSTRACT

A lock for a revolving door includes an electrically-controlled, solenoid-extensible trip rod engageable by a panel of the door. Movement of the rod by the door panel rotates a key from a lock holder to release a spring-biased locking element which is forced onto a door panel to prevent further rotation of the door.

22 Claims, 4 Drawing Sheets

SECURITY LOCK FOR REVOLVING DOOR

BACKGROUND OF THE INVENTION

1. Field of the Invention

The invention relates generally to a lock or securing system, especially a door lock, and is directed more particularly to an electrically-controlled lock for a revolving door.

2. Prior Art

Selectively-activated, electrically-controlled locks for revolving doors are known in the prior art which include one or more locking members vertically extensible to prevent rotation of the door. Examples of such locks are disclosed in the following U.S. patents:

| | | |
|---|---|---|
| 1,455,677 | Stevens | May 15, 1923 |
| 1,493,690 | Martin | May 13, 1924 |
| 1,952,393 | Tigue | Mar. 27, 1934 |
| 1,979,497 | Schneider et al. | Nov. 6, 1934 |
| 2,186,385 | Lockhart | June 9, 1940 |
| 2,695,574 | Ceci | Nov. 30, 1954 |
| 3,045,615 | Atchison | July 24, 1962 |
| 3,285,209 | Pace | Nov. 15, 1966 |
| 4,060,935 | Miller et al. | Dec. 6, 1977 |
| 4,341,165 | Calandritti et al. | July 27, 1982 |

Lockhart discloses a lock controlled by a switch-activated motor which causes a pair of levers to pivot and force a pin to register in one of several holes in an annular channel provided in a circular plate located above the revolving door. In the lock of Schneider et al., a biased bolt is released by a solenoid to enter one of several holes in a circular element attached to the top of the doors. The control circuit and switches permit the bolt to be inserted into and retracted from the hole.

Instead of a circular element as used in Schneider et al., Pace uses a curved cam plate attached to the door's central column. A solenoid-controlled, biased plunger is forced into one of four holes in the periphery of the plate to lock the door, with separate solenoids releasing and retracting the plunger.

Stevens uses an electrically-controlled trigger to push down a post which forces four horizontally-movable, biased rods between vertical bars. A screw jack is used to move the post upwardly to permit withdrawal of the rods by cooperating springs.

Martin provides a vertically movable shaft having a shaped head portion, retained by an electrically-actuated latch, which is permitted to drop into a similarly-shaped recess to lock the revolving door. Ceci uses a cable-operated system to vertically extend bars between the doors to prevent rotation thereof.

The other patents describe other types of locks for a revolving door. Calandritti et al., Miller et al. and Atchison each uses a drive motor to prevent door rotation, and Tigue uses meshing gear sectors.

SUMMARY OF THE INVENTION

Among the objects of the invention are to provide an improved lock for a revolving door of the selectively-activated, electrically-controlled type; to provide an improved lock of this type which can be installed on existing revolving doors with minimum modification or alteration to the door structure and which does not affect the door's operation when the lock is inoperative; to provide an improved lock of the foregoing type having a lock-release key operated by rotation of the door; to provide an improved lock of the foregoing type having a locking element which engages both sides of a door panel for increased, effective stopping of the door; and to provide an improved lock of the foregoing type having a spring-biased locking element restrained by a key released by rotation of the door.

These and other objects of the invention are attained in a lock particularly adapted, upon operation, to rotationally immobilize a revolving door, which includes a lock assembly activating rod controllably extensible into the path of the door by an electromagnetic coil. Movement of the rod by rotation of the door rotates a key into a release position permitting a spring-biased locking member to be forced onto the edge of the door, straddling both sides of the door to prevent its rotation. The lock is reset by retracting the key rod and locking member into the assembly housing and rotating the key into position to restrain the locking member against the bias of its spring.

DETAILED DESCRIPTION

Figure 1:
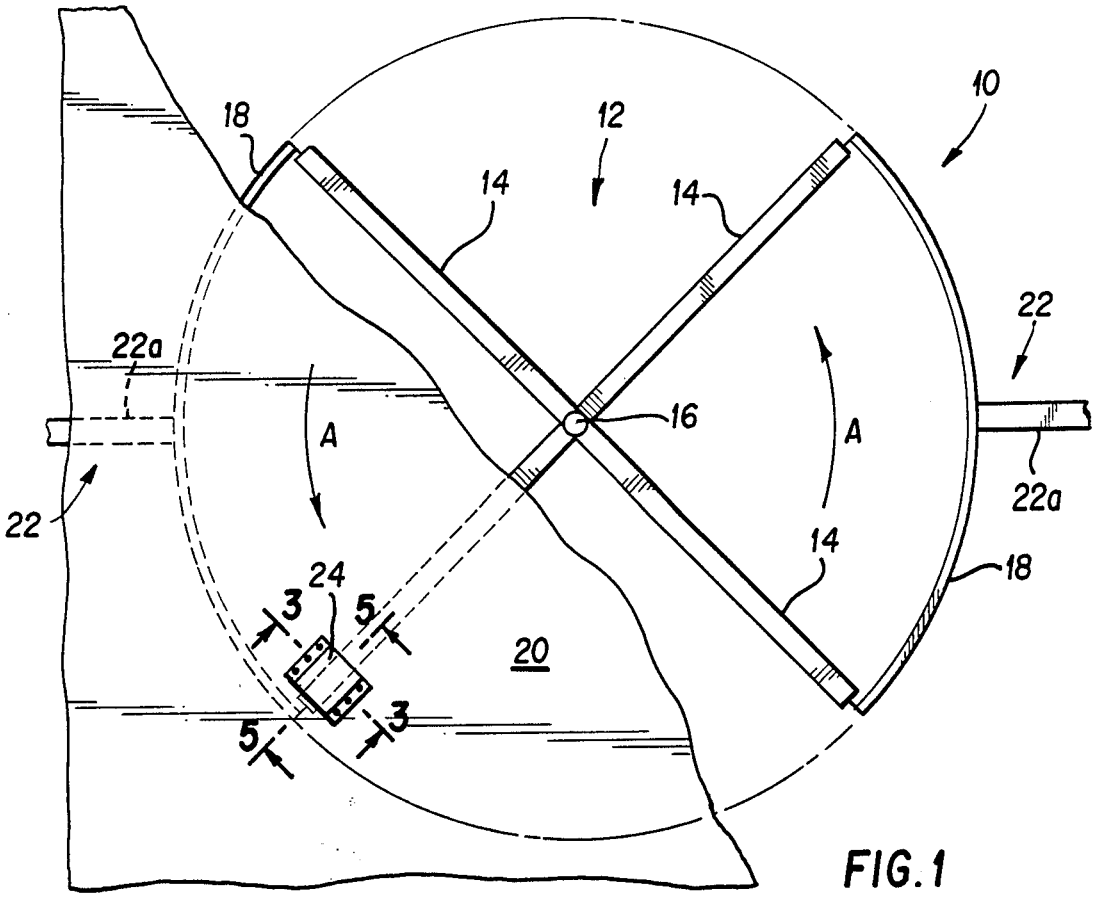
FIG. 1 is a top, plan view of a revolving door assembly with the security lock of the present invention installed thereon.
Figure 2:
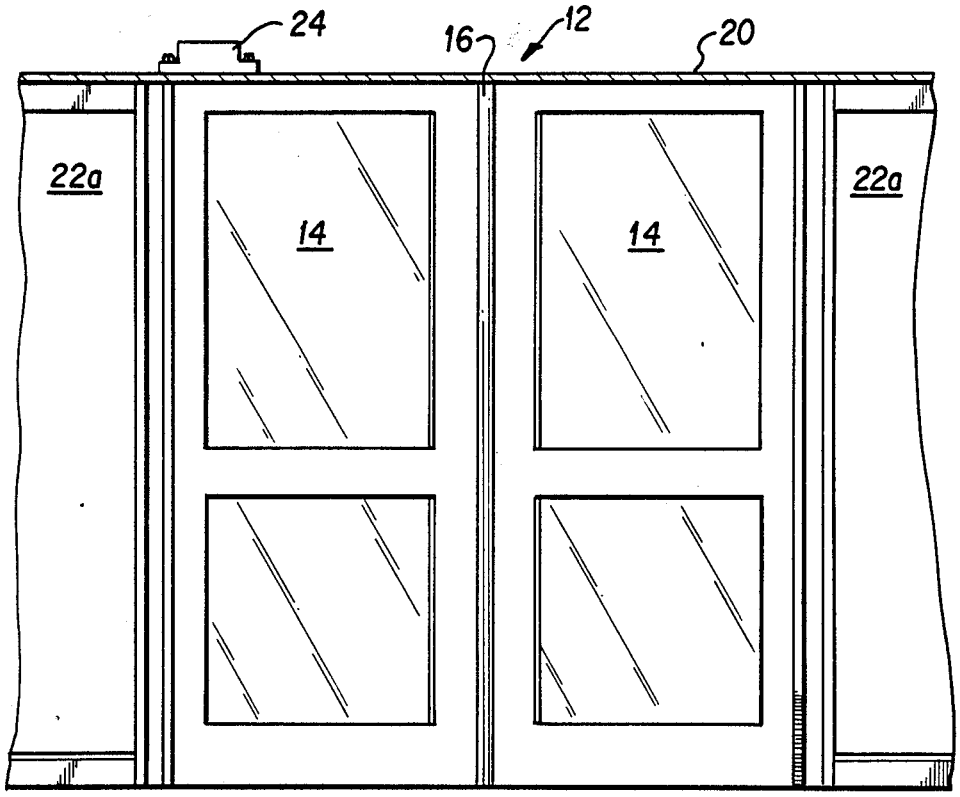
FIG. 2 is a front, elevational view of the door assembly of FIG. 1.

Referring more particularly now to the drawings, FIGS. 1 and 2 show a revolving door assembly or installation, generally indicated at 10, which provides controlled entry and exit from a building or similar structure. The revolving door assembly 10 includes a revolving door 12 having a plurality of individual doors or leaves 14, each supported along a vertical edge by a central, rotatable support 16, and selectively rotatable in one direction, such as the counterclockwise direction indicated by the arrow A. The central support 16 is suitably anchored at its extremities, and bearings (not shown) are provided for ease of rotation of the door panels 14. While the drawings illustrate the door 12 to have four, diametrically-disposed leaves or panels 14, any number of such leaves may be provided. The individual panels or leaves 14 of the revolving door 12 is preferably made of a transparent material, which may be impact- or shatter-resistant.

The revolving door 12 rotates within a cylindrical envelop partly defined by two, fixed, vertically-extending, diametrically-opposed cylindrical sectors 18 which, preferably, are made of a transparent material such as glass or plastic. If the revolving door assembly 10 provides entry and exit from a secured premise, the cylindrical sectors 18 may be made of an impact- or shatter-resistant material. The cylindrical envelop in which the revolving door 12 rotates is topped by a canopy or roof 20, which is partially shown in FIG. 1, and may be horizontally coextensive with the building ceiling as shown in FIG. 2, or may be at a lower height. A wall structure 22 extends from the sectors 18 to complete the revolving door installation 10, with the portions 22*a* of the wall closest to the cylindrical sectors being of a transparent material, if so desired.

The security lock of the present invention, identified generally at 24, is mounted on the canopy 20 of the revolving door 12, adjacent to the outer radial edge thereof, so as to engage the outer radial edge of the door panel 14 disposed there beneath.

Figure 4:
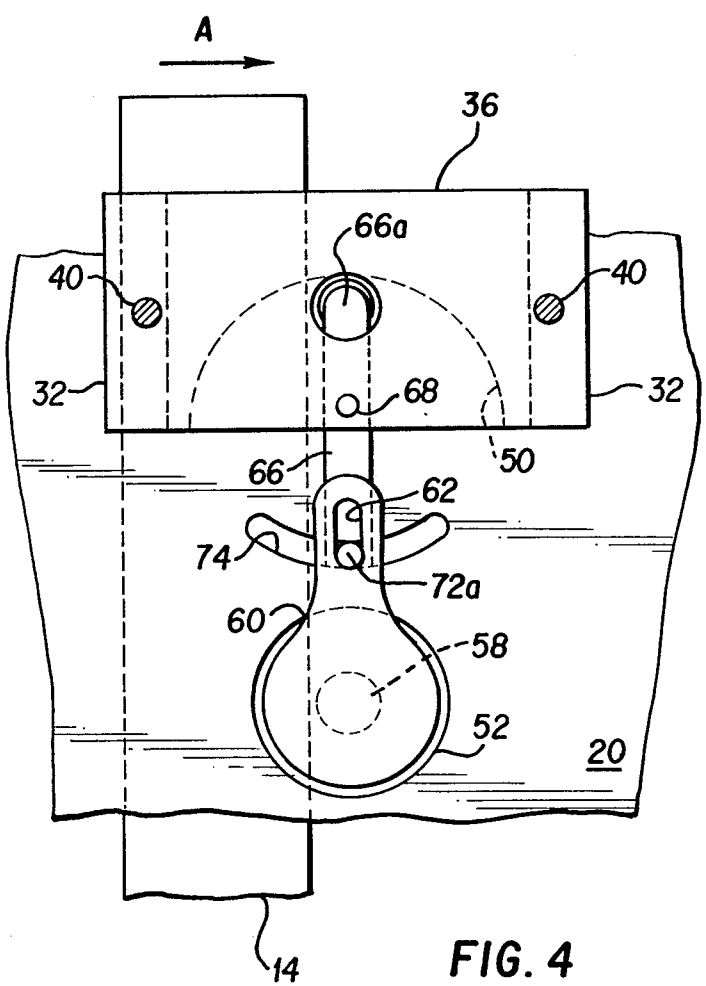
FIG. 4 is a cross-sectional view of the lock, as seen along line 4—4 in FIG. 3, with some of the structure omitted for greater clarity.
Figure 3:
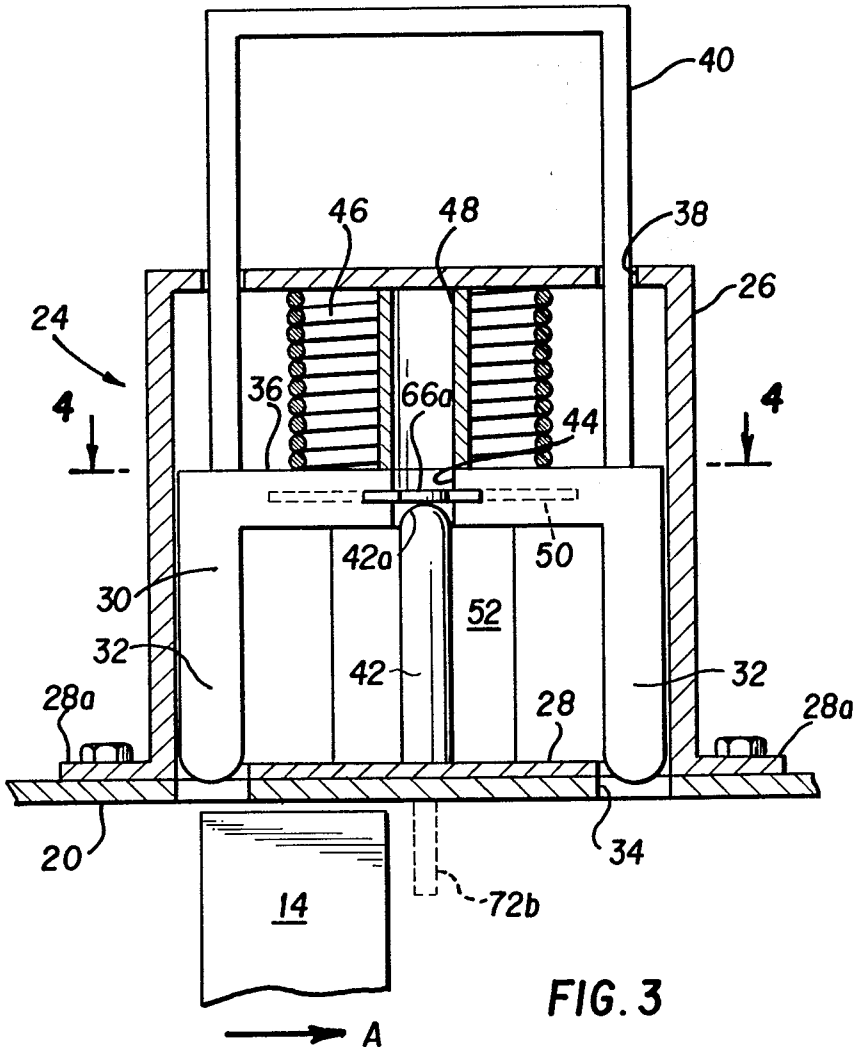
FIG. 3 is a cross-sectional view of the lock, as seen along line 3—3 in FIG. 1.
Figure 5:
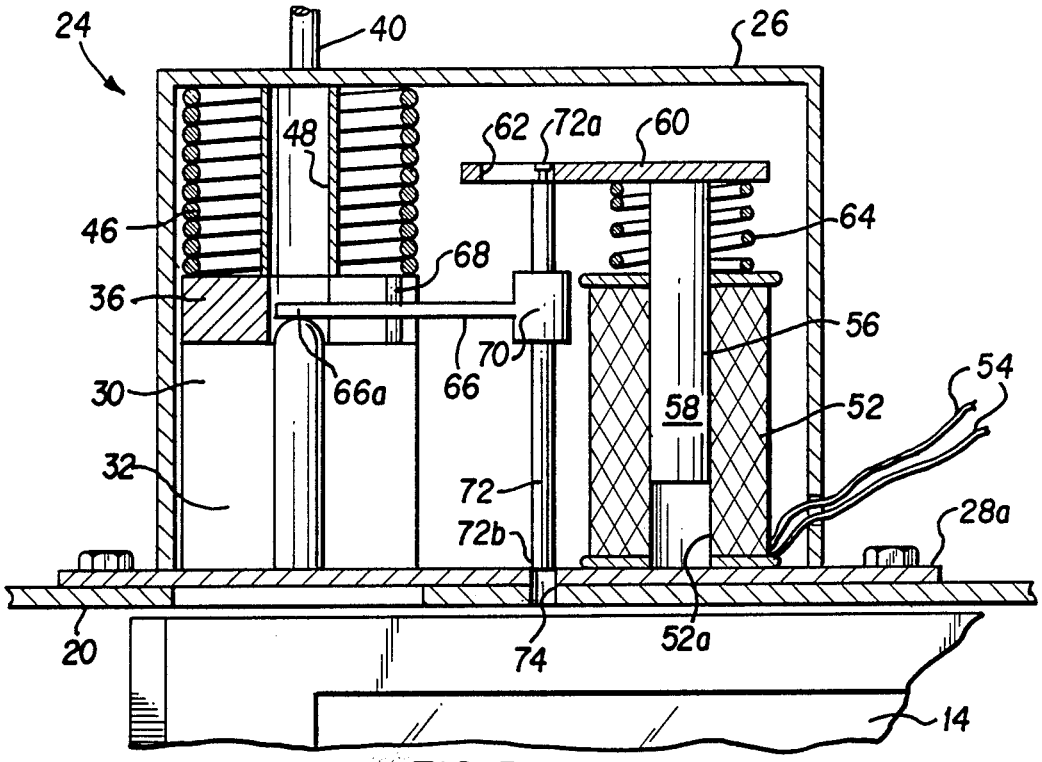
FIG. 5 is a cross-sectional view of the lock, as seen along line 5—15 in FIG. 1.

Referring now to FIGS. 3, 4 and 5, the security lock, or simply lock, 24 includes a housing 26 attached to a floor or base 28 which extends peripherally beyond the housing to form a flange 28*a* by which the lock is securely mounted on the canopy 20 of the revolving door, such as with bolts as shown in the figures. Disposed within the lock housing 26 is a locking element 30 which, in cross-section, resembles an inverted U. The downwardly-extending sides 32 of the locking element 30 pass through elongated slots or openings 34 extending through the base 28 and the roof or canopy 20 of the revolving door. The locking element 30 includes a cross member or cross piece 36 interconnecting the sides 32, and is preferably integrally formed therewith. Attached to the cross piece 36, and extending through openings 38 provided in the upper surface of the lock housing 26, is an inverted U-shaped handle 40.

Fixed to the base 28 of the lock housing 26 is a lock holder 42 in the shape of a vertically-extending cylindrical rod having a smooth, contoured upper end surface 42*a*. A circular bore 44 extends through the thickness of the cross piece 36 and is sized to permit the free passage of the lock holder 42 therethrough. The ends of a coil spring 46 are biased against the upper surface of the cross piece 36 and the inner surface of the upper wall of the lock housing 26, as shown in FIG. 3. A guide means 48, fixed to and movable with the locking element 30, extends coaxially above the bore 44, to permit unobstructed passage of the lock holder 42 upwardly through the interior of the coil spring 46 during operation of the security lock, as explained more fully below. The guide means 48 may be a hollow cylindrical tube having a height equal to the compressed length of spring 48.

As shown more particularly in FIGS. 3 and 4, disposed midway in the thickness of the cross piece 36 is a recess 50 of a predetermined size (as seen in FIG. 3) and a semi-circular planform, as shown in FIG. 4.

Disposed adjacent to the locking element 30 is an electromagnetic coil 52 having a central, cylindrical bore 52*a* extending therethrough. Wires 54 connect the coil 52 to an electric source and a control switch, both of which are not shown. A plunger 56 has a cylindrical shaft 58 which is slidably and rotatably received within the bore 52*a* of the electromagnetic coil 52. The plunger 56 is provided with a laterally-extending tab portion 60 at the upper end of the shaft 58, and as shown in FIG. 4, this tab portion is rovided with an elongated slot 62 adjacent to the end remote from the shaft 58. A spring 64 is positioned around the shaft 58, and has its ends biased against the under surface of the tab portion 60 and the upper portion of the electromagnetic coil 52, to bias the plunger 56 upwardly, into the position shown in FIG. 5.

A key 66 is rotatably supported on the cross piece 36 of the locking element 30 by a pin 68 affixed thereto, such that the key is vertically movable with the locking element and is rotatable about the axis of the pin. One end portion 66*a* of key 66, the left hand portion as viewed in FIGS. 5 and 6, rotates within the recess 50 (note FIGS. 4 and 8) and is adapted to engage the upper, contoured surface 42*a* of the lock holder 42, to bias the spring 46 in the compressed condition shown in FIGS. 3, 5 and 6, as will be explained more fully below. The other end of the key 66 is provided with a cylindrical boss 70 having a central bore extending vertically therethrough, the bore not being visible in the drawings. Slidably received within the bore in the boss 70 is an elongated key rod 72 having its upper end 72*a* supported by the tab portion 60 and adapted for reciprocation within the elongated slot 62, the lower end portion 72*b* of the key rod being adapted to pass through aligned, elongated holes in the base 28 of the lock housing 26 and the canopy 20 of the revolving door 12. As shown more fully in FIGS. 4 and 8, the aligned opening in the base 28 and canopy 20 through which the lower end portion 72*b* of the key rod 72 passes, is configured in an arcuate, semi-circular elongated slot 74. The upper end portion 72*a* of the key rod 72 may be provided with means, such as an enlarged head portion, which the key rod and the elongated slot 62 in the tab portion 60 of plunger 56.

When the lock 24 is in the set or non-operative condition, the locking element 30 is completely retracted within the lock housing 26, compressing the spring 46 between the interior of the top wall of the housing and the top surface of the cross piece 36, as shown more particularly in FIGS. 3 and 5. The locking element 30 is maintained in this condition by the interior portion 66*a* of the key 66 resting on the upper, contoured surface 42*a* of the key holder 42. As shown in FIG. 4, the key 66 is co-linearly aligned with the tab portion 60 of plunger 56. The electromagnetic coil 52 is de-energized, permitting the spring 64 to raise plunger 56 into its uppermost position as shown in FIG. 5, thus retracting the key rod 72 entirely within the lock housing 26. In this position the key rod 72 is at approximately the mid-point of slot 74 provided in the door roof 20, and is at the lowermost end of the elongated slots 62 of the plunger 56 as shown in FIG. 4.

With the lock 24 thusly set, the door 12 is free to rotate in the direction indicated by arrow A of FIG. 1. When it is desired to prevent entry or exit through the revolving door assembly 10, the electromagnetic coil 52 is appropriately energized, either by manual operation of a control switch or by automatic operation of a sensor means, which sensor means may be responsive to metal detectors, alarm systems, etc. In the latter situation, it may be desired to couple locking of the revolving door 12 with activation of another sensor or detection system, such as a metal detector, a burglar system, or similar means.

When the electromagnetic coil 52 is energized, shaft 58 of the plunger 56 is forcibly drawn into the bore 52*a* of the coil, forcing the key rod 72 downwardly, with the lower end portion 72*b* extending below the canopy 20 of the revolving door assembly and compressing spring 64. This is shown by the dotted lines for key rod portion 72*b* in FIG. 3, and by the solid portions in FIGS. 6 and 7. In this condition, the lock is "cocked", ready to be activated by further rotation of the revolving door 12.

Figure 8:
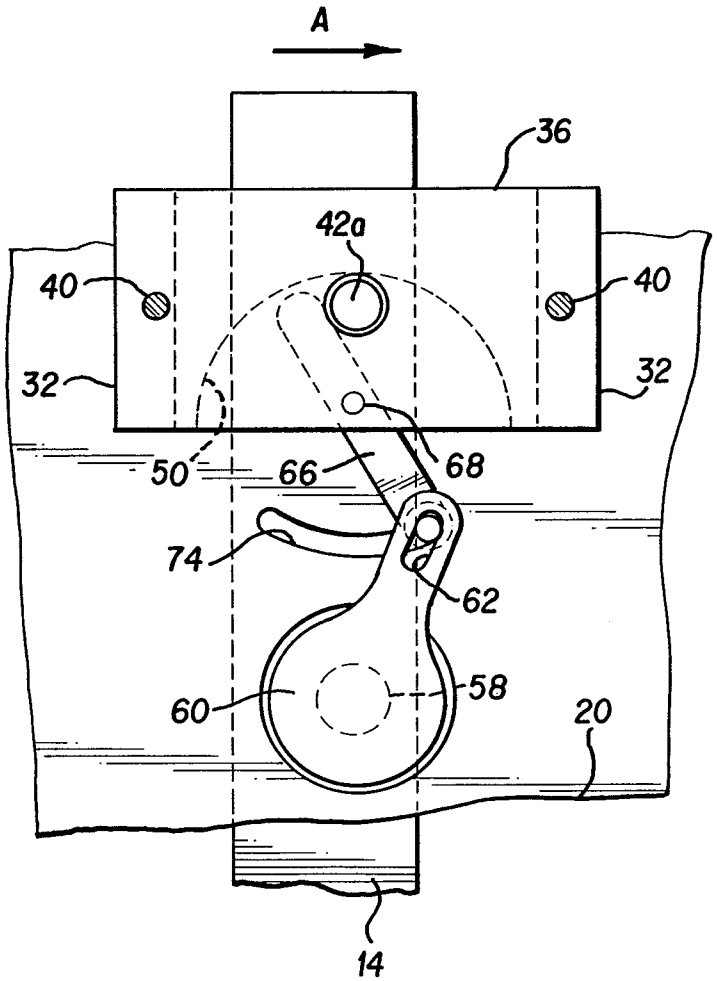
FIG. 8 is a cross-sectional view of the lock, as seen along line 8—8 in FIG. 7, with some of the structure omitted for greater clarity.
Figure 7:
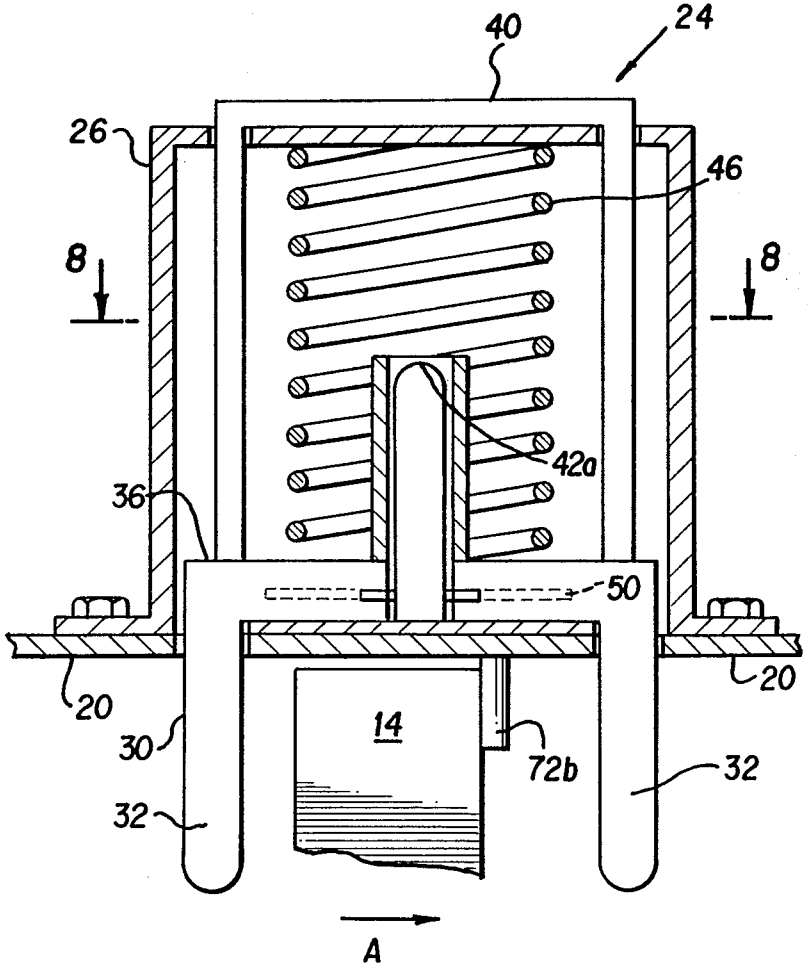
FIG. 7 is a view similar to FIG. 3, showing the lock in the door-engaging position.

When the door panel 14 is pushed in the direction of arrow A (FIG. 3) the door contacts the lower portion 72*b* of the key rod, moving it to the right, causing it to move within the slot 74. This movement causes the tab portion 60 of plunger 56 to rotate clockwise in FIG. 4, and at the same time causes the interior end portions 66*a* of the key 66 to rotate counter-clockwise about the pin 68. Continued rotation causes the key 66 to slide off of the tip 42*a* of the lock holder 42, and assume the position as shown in FIG. 8. Release by the lock holder 42 permits the spring 46 to force the locking element 30 downwardly on top of the door panel 14, with the downwardly-extending sides 32 thereof straddling the front and back surfaces of the door panel, as shown in FIG. 7, thus preventing further rotation of the door 12. Reference to FIG. 1 will show that in this locked condition, two adjacent panels 14 of the door align with the ends of the curved sectors 18, effectively trapping a person within.

Should a door panel 14 be directly beneath key rod 72 at the time coil 52 is energized, the door 12 may continue to be rotated until the upper edge thereof clears the lower portion 72*b* of the key rod, after which the lock 24 operates in the manner described above.

To release the revolving door 12 and to reset the security lock 24, electromagnetic coil 52 is de-energized, permitting the spring 64 to raise the plunger 56 and, concurrently, to retract the key rod 72 within the lock housing 26, into the condition shown in FIG. 5. The locking element 30 is retracted into the lock housing 26 by manually pulling upwardly on the reset handle 40, from the position shown in FIG. 7 to the position of FIG. 3, compressing the spring 46 in the process. When the key 66 has vertically cleared the top of the key holder 42, indicated tactilly by abutment of guide means 48 with housing 26, the key is rotated clockwise about the pin 68 (FIG. 8) until the interior end portion 66*a* again contacts the contoured surface 42*a* of the key holder. This can be visually determined by the colinear alignment of the key 66 with the tab portion 60 of plunger 56 (FIG. 4). Additionally, the surface of end portion 66*a* which contacts the lock holder 42*a* may be provided with a dimple or depresssion which receives the crown point of the contoured surface 42*a*, so that as the key 66 is rotated into position, the dimple will slide over the contoured surface 42*a* and provide a tactile indication that it is properly positioned. Subsequently, the reset handle 40 is released, and the spring 46 maintains the key 66 in position, with the lock 24 in condition for subsequent activation, in the manner described above.

The foregoing procedure for releasing the revolving door 12 and resetting the security lock 24 may be achieved mechanically and/or automatically, such as with hydraulically-, pneumatically- and/or electrically-operated mechanisms for raising the reset handle 40 and resetting the key 66.

Figure 6:
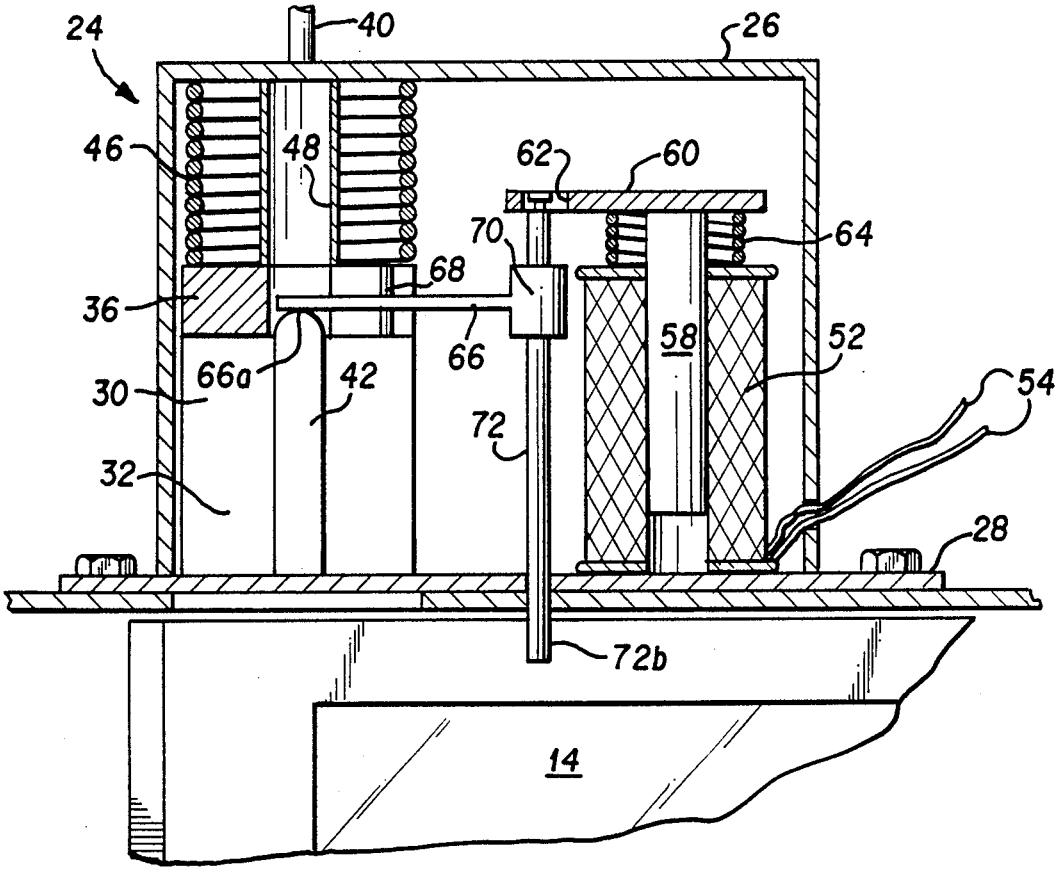
FIG. 6 is a view similar to FIG. 5, showing the lock in an intermediate operating condition.

While the door has been shown to revolve in the counterclockwise direction (FIG. 1), the disclosed security lock of the present invention will work when the door is set to rotate in the opposite direction since the key rod 72, in its extended, downward position of FIGS. 6 and 7, can rotate either clockwise or counterclockwise within the elongated slot 74 and the key 66 can correspondingly rotate in either direction about the pin 68 (note FIGS. 4 and 8). Although the recess 50 in which the key 66 rotates, has been described as a substantially enclosed, recessed chamber provided within the thickness of the cross piece 36 of the locking member 30, alternative equivalent configurations for this recess are within the scope of the disclosed invention. For example, the cross piece 36 may remain the thickness indicated, for instance, in FIG. 7, and the semi-circular recess milled or otherwise formed in the lower surface of the cross piece, such that the pivot pin 68 is supported from the upper surface of the cross piece. Alternatively, the vertical thickness of the cross piece 36 may be reduced from that schematically illustrated in FIG. 7, to approximately one half of the indicated thickness, so that the pivoted key 66 may rotate beneath the lower surface of the reduced-thickness cross piece. In addition to the dimple or recess provided on the inner end portion 66*a*, alignment marks may be provided on the adjacent portions of the key 66 and tab portion 60 to further provide a visual indication that the lock 24 is properly set.

There has been disclosed an effective lock for a revolving door which can be readily incorporated into new door installations, or just as readily incorporated into existing door installations, the latter being accomplished with a minimum of alterations or modifications to the door structure and requiring no change to the door's operation. Installation of the lock on an existing revolving door requires only cutouts in the door's canopy for the key rod and the locking element, and the mounting of the lock housing on the canopy. The lock is effective on revolving doors with any number of individual panels and does not affect the normal operation of the door.

The security lock is not restricted to placement on the door canopy or even at the top of the revolving door. Other locations may be equally suitable, provided the key rod is engageable by the door and the locking element is positioned to straddle an edge of the door in the locked condition. Thus, the lock may be located anywhere along the height of the door, or may be appropriately placed beneath the lower edge of the door.

While the security lock of the present invention may be used to control any revolving door providing entry and exit from any area, the invention offers particular advantages for the remote-controlled locking of a revolving door providing entry and exit from a controlled area, such as a bank, an airport access area, data and-security sensitive areas, or similar areas in which it is highly desirable to be able to immediately lock the revolving door from remotely-controlled locations, to be able to prevent entry into the area, exit therefrom, or to detain a person within the revolving door assembly.

Although not specifically described herein or illustrated in the drawings, it is understood that all of the components described above are arranged and supported in an operative fashion to provide a complete, operative system. Further, it is understood that all ancillary components have not been specifically described, but such components are known in the art and are appropriately incorporated into the operative system.

Of course, additional and other variations of the specific construction and arrangement of the security lock for a revolving door described and disclosed above can be made by those skilled in the art without departing from the invention as defined in the appended claims.

I claim:

1. A lock for a door comprising:

(a) an actuator movable in a first direction into the path of the door for contact by the door, said actuator movable by a selectively-activatable means;

(b) a locking element movable into a first, door-arresting position whereat said locking element contacts the door to prevent movement of the door, said locking element being urged into said first position by a biasing member; and (c) a latching member coupled to said actuator and cooperating with said locking element to releaseably restrain said locking element in a second position whereat the locking element is separated from engagement with the door, said latching member and said actuator movable in a second direction to release the locking element for movement into said first position.

2. The lock as set forth in claim 1, wherein said selectively-activatable means includes an electromagnetic coil, and said locking element has portions which simultaneously contact two surfaces of the door in said first position.

3. The lock as set forth in claim 2, wherein said actuator comprises a rod member movable along said first direction by said coil, said latching member is disposed for movement with said locking element between said first and said second positions and is supported on said locking element for movement in said second direction, and further comprising means coupling said actuator and said latching member for movement in said first and said second directions.

4. The lock as set forth in claim 3, wherein said latching member is rotatably supported on said locking element, and said coupling means comprises:

(a) connecting means joining said rod member and said latching member and adapted to permit sliding motion between said rod member and said connecting means; (b) extension means connected to the core of said electromagnetic coil, said core being reciprocally and rotationally movable relative to said coil; and (c) an elongated slot on said extension means, an end portion of said rod member being received within said slot, said coupling means cooperating to permit independent reciprocal movement along said first direction of said rod member, said latching member and said extrusion means, and coordinated movement of the rod member, latching member and extrusion means in said second direction, in response to movement of the door, to release the locking element for movement into said first position.

5. The lock as set forth in claim 4, further including a detent means cooperating with said latching member to restrain said locking element in said second position.

6. A lock assembly for a revolving door having a door panel rotatable about a vertical axis along an edge of said panel, said lock assembly comprising:

(a) an actuator movable in a first direction into the path of the rotating door panel;

(b) control means for moving said actuator along said first direction;

(c) a locking element movable into a first, door-arresting position whereat said locking element contacts the door panel to prevent rotation of the panel;

(d) a biasing means urging said locking element into said first position;

(e) a latching member rotatably supported on said locking element and movable with said locking element along said first direction; and (f) means coupling said actuator and said latching member for movement in said first and a second direction, said latching member and said actuator movable in said second direction to release the locking element for movement into said first position.

7. The lock assembly of claim 6, wherein said control means includes an electromagnetic coil having a core reciprocally and rotationally movable relative to the coil, said actuator comprising a rod member with an end portion being coupled to said core for reciprocal movement along said first direction and rotational movement relative to said coil.

8. The lock assembly of claim 7, wherein said locking element has a bifurcated end portion which straddles an edge of the door panel in said first position with the bifurcated segments being disposed adjacent to each side of the panel.

9. The lock assembly of claim 8, further including a detent means cooperating with said latching member to restrain said locking element is separated from engagement with the door panel.

10. The lock assembly of claim 9, wherein said coupling means comprises:

(a) a bore at an end portion of said latching member said rod member being slidably and rotationally received within said bore;

(b) a tab portion extending transversely from an end portion of said coil core; and (c) an elongated slot on said tab portion, an end portion of said rod member being received within said slot, said coupling means cooperating to permit independent reciprocal movement along said first direction of said rod member, said latching member and said tab portion on said coil, and coordinated movement of the rod member, latching member and tab portion in said second direction, in response to rotational movement of the door panel, to release the locking element for movement into said first, door-arresting position.

11. The lock assembly of claim 10, wherein said second direction is substantially along the direction of movement of the door panel, and said first direction is substantially orthogonal to said first direction.

12. The lock assembly of claim 11, wherein said biasing means includes a coil spring and said detent means includes an elongated rod stationary relative to said latching member, said detent rod having an end portion cooperating with said latching member to restrain said locking element in said second position, whereat said coil spring is compressed.

13. The lock assembly of claim 10, further comprising reset means coupled to said locking element for moving the locking element from said first, door-arresting position to said second position.

14. In combination with a revolving door installation having a door panel rotatable about a vertical axis extending along a vertical edge of said panel, a lock assembly selectively activatable to arrest rotation of the door panel, said lock assembly comprising:

(a) an actuator movable in a first direction into the path of the rotating door panel for contact by said panel to operate the lock;

(b) control means coupled to said actuator for moving said actuator along said first direction;

(c) a locking element movable from a first, unlocked position whereat said locking element is spaced from engagement with the door panel, into a second, door-arresting position whereat said locking element contacts the door panel to prevent rotation of the panel;

(d) a biasing means urging said locking element from said first position into said second position;

(e) a latching member rotatably supported on said locking element and movable with said locking element along said first direction, said latching member adapted to restrain said locking element in said first position; and (f) means coupling said actuator and said latching member for movement in said first and a second direction, said latching member and said actuator movable by the door panel in said second direction to release the locking element for movement into said second position.

15. The combination of claim 14, wherein:

said control means includes an electromagnetic coil having a core reciprocally and rotationally movable relative to the coil;

said actuator comprises a rod member having an end portion coupled to said core for reciprocal movement with the core along said first direction and rotational movement relative to said coil; and said locking element includes a bifurcated end portion which straddles an edge of the door panel in said second position, with the bifurcated segments being disposed adjacent to each side of the panel.

16. The combination of claim 15, further comprising detent means stationarily disposed relative to said locking element and cooperating with said latching member to restrain the locking element in said first position.

17. The combination of claim 16, wherein said coupling means comprises;

(a) a bore at an end portion of said latching member, said rod member being slidably and rotationally received within said bore;

(b) a tab portion extending transversely from an end portion of said coil core; and (c) an elongated slot on said tab portion, an end portion of said rod member being received within said slot, said coupling means cooperating to permit independent reciprocal movement along said first direction of said rod member, said latching member and said tab portion on said coil, and coordinated movement of the rod member, latching member and tab portion in said second direction, in response to rotational movement of the door panel, to release the locking element for movement from said first, unlocked, position, into said second, door-arresting position.

18. The combination of claim 17, wherein said biasing means comprises a coil spring, and said detent means comprises an elongated rod disposed to extend within said spring and having an end portion contacted by said latching member when said locking element is in said first position, and said coil spring is compressed.

19. The combination of claim 18, further comprising reset means coupled to said locking element for moving the locking element from said second position to said first position.

20. The combination of claim 19, wherein said second direction is substantially along the direction of movement of the door panel, and said first direction is substantially orthogonal to said first direction.

21. The combination of claim 20, wherein said revolving door installation includes:

arcuate, vertically-extending walls disposed to form portions of a cylindrical space within which said revolving door rotates; and said revolving door comprises at least two door panels rotatable about said vertical axis and disposed such that when the revolving door is arrested by the lock assembly, adjacent door panels are positioned at the lateral ends of an arcuate wall to form an enclosed volume defined by said adjacent door panels and said arcuate wall.

22. The combination of claim 21, further including operating means for said electromagnetic coil, said operating means located remotely from said revolving door.

* * * * *